US008580187B2

(12) United States Patent
Masuda

(10) Patent No.: US 8,580,187 B2
(45) **Date of Patent: *Nov. 12, 2013**

(54) MELT SUPPLY PIPE FOR ALUMINUM DIE CASTING

(75) Inventor: Jun Masuda, Mishima (JP)

(73) Assignee: Toshiba Kikai Kabushiki Kaisha, Tokyo-To (JP)

( * ) Notice: Subject to any disclaimer, the term of this patent is extended or adjusted under 35 U.S.C. 154(b) by 725 days.

This patent is subject to a terminal disclaimer.

(21) Appl. No.: 12/293,556

(22) PCT Filed: Mar. 23, 2007

(86) PCT No.: PCT/JP2007/056048

§ 371 (c)(1),
(2), (4) Date: Sep. 19, 2008

(87) PCT Pub. No.: WO2007/111257

PCT Pub. Date: Oct. 4, 2007

(65) Prior Publication Data

US 2010/0084439 A1 Apr. 8, 2010

(30) Foreign Application Priority Data

Mar. 24, 2006 (JP) ..... 2006-083312

(51) Int. Cl.
*B22D 17/30* (2006.01)

(52) U.S. Cl.
USPC ..... 266/236; 266/286

(58) Field of Classification Search
USPC ..... 266/280, 286, 236; 164/306
See application file for complete search history.

(56) References Cited

U.S. PATENT DOCUMENTS 3,495,630 A 2/1970 Hansen et al.
4,197,902 A 4/1980 Von Jan et al.

(Continued)

FOREIGN PATENT DOCUMENTS

EP 06 95 598 2/1996
JP 51-20303 2/1976

(Continued)

OTHER PUBLICATIONS

Office Action issued in U.S. Appl. No. 10/599,118, mailed Jul. 22, 2009.

(Continued)

*Primary Examiner* — Scott Kastler
(74) *Attorney, Agent, or Firm* — DLA Piper LLP (US)

(57) ABSTRACT

There is provided a melt supply pipe comprising a melt supply pipe body composed of an inner ceramic pipe and an outer steel pipe, the outer steel pipe having a Ni alloy layer formed over the inner circumferential surface, and TiC particles attached to the surface of the Ni alloy layer, wherein grooves are formed at both ends of the melt supply pipe body, each groove forming an annular space overlapping the boundary between the outer circumferential surface of the inner ceramic pipe and the inner circumferential surface of the outer steel pipe, and a fibrous sheet of an inorganic material is inserted into each of the annular grooves such that the sheet extends over the entire circumference of the groove. The melt supply pipe is strong to mechanical impact owing to the use of the steel pipe in combination with the ceramic pipe and can prevent intrusion of an aluminum melt despite the difference in thermal expansion between the steel pipe and the ceramic pipe.

24 Claims, 3 Drawing Sheets

(56) References Cited

U.S. PATENT DOCUMENTS

| | | | | |
|---|---|---|---|---|
| 4,733,715 | A * | 3/1988 | Matsuzaki et al. | 164/306 |
| 4,868,069 | A | 9/1989 | Darrow | |
| 4,951,888 | A | 8/1990 | Sharpe et al. | |
| 4,995,427 | A | 2/1991 | Berchem | |
| 4,996,114 | A | 2/1991 | Darrow | |
| 8,333,920 | B2 * | 12/2012 | Masuda et al. | 266/236 |
| 2005/0116192 | A1 | 6/2005 | Vincent | |
| 2007/0144627 | A1 | 6/2007 | Masuda et al. | |
| 2007/0196684 | A1 | 8/2007 | Masuda | |

FOREIGN PATENT DOCUMENTS

| | | |
|---|---|---|
| JP | 03-126681 | 5/1991 |
| JP | 07-001077 | 1/1995 |
| JP | 08/025063 | 1/1996 |
| JP | 08-132215 | 5/1996 |
| JP | 08-229657 | 9/1996 |
| JP | 2000-351054 | 12/2000 |
| JP | 2001-287004 | 10/2001 |
| JP | 2001-300711 | 10/2001 |
| JP | 2001-342530 | 12/2001 |
| JP | 2002-066708 | 3/2002 |
| JP | 2003-170262 | 6/2003 |
| JP | 2005-264306 | 9/2005 |
| KR | 10-1987-11269 | 12/1987 |

OTHER PUBLICATIONS

Office Action issued in U.S. Appl. No. 11/565,771, mailed Jun. 24, 2009.
File History of U.S. Appl. No. 10/599,118.
Office Actions issued in U.S. Appl. No. 11/565,771 on Dec. 7, 2009.
English Language Abstract for JP 2005 264306 published Sep. 25, 2009.
English Language Abstract for JP 2000 351054 published Dec. 19, 2000.
International Search Report of PCT/JP2007/056048.
English language translation of JP-2005-264306.
English language translation of JP-2000-351054.
English language translation of JP-2002-066708.
Office Action issued in U.S. Appl. No. 10/599,118, on Jun. 27, 2008.
JP 2001-342530 English Machine. Translation, Honma et al., Dec. 2001.
JP 2001-300711 English Machine. Translation, Negishi, Oct. 2001.
JP 08-229657 English Machine Translation, Nakayama et al., Sep. 1996.
JP 76020303, Nippon Tungsten KK, Jun. 1976, Titanium Carbide Cement Scraping Tool Formed as a Nitrided Layer on Steel Substrate, English Abstract from DWPI Database.
International Preliminary Examination Report for PCT/JP05/000510, Jan. 2007.
Notice of Allowance issued in related Korean Parent Application No. 2006-018288, mailed Apr. 4, 2008.
English language abstract of JP 03-126681, published May 29, 1991.
Machine English language translation of JP 08-025063, published Jan. 30, 1996.
English language abstract of JP 08-025063, published Jan. 30, 1996.
Machine English language translation of JP 2001-287004, published Oct. 16, 2001.
English language abstract of JP 2001-287004, published Oct. 16, 2001.
English language abstract of KR 10-1987-0011269, published Dec. 22, 1987.
Office Action issued in U.S. Appl. No. 11/565,771 mailed Oct. 28, 2008.
English Language Abstract for JP 08-229657.
English Language Abstract for JP 2001-300711.
English Language Abstract for JP 2001-342530.
English language translation of International Preliminary Report on Patentability issued in Application No. PCT/JP07/056048 mailed Nov. 13, 2008.
Final Office Action issued in U.S. Appl. No. 10/599,118 mailed Feb. 3, 2009.
International Search Report issued in PCT/JP05/05100 on Jul. 5, 2005.
English Language Abstract of JP-2002-066708.
Japanese Office Action issued in Application No. 2004-82990 mailed Apr. 7, 2009.
English Translation of Japanese Office Action issued in Application No. 2004-82990 mailed Apr. 7, 2009.
Machine English language translation of JP 07-001077, published Jan. 6, 1995.
English Abstract of JP 07-001077.
Machine English language translation of JP 2003-170262, published Jun. 17, 2003.
English Abstract of JP 2003-170262.
Machine English language translation of JP 08-132215, published May 28, 1996.
English Abstract of JP 08-132215.
U.S. Office Action issued in related U.S. Appl. 12/891,477 on Aug. 3, 2011.
File History of U.S. Appl. 10/599,118.
File History of U.S. Appl. 11/565,771.
File History of U.S. Appl. No. 11/565,771.
File History of U.S. Appl. No. 12/891,477.
Image File History of U.S. Appl. No. 11/565,771.
Image File History of U.S. Appl. No. 12/891,477.
Partial File History of U.S. Appl. No. 11/565,771.
Partial File History of U.S. Appl. No. 13/675,830.

* cited by examiner

MELT SUPPLY PIPE FOR ALUMINUM DIE CASTING

TECHNICAL FIELD

The present invention relates to a melt supply pipe for supplying an aluminum melt from a melting furnace to a die casting machine in aluminum die casting.

BACKGROUND ART

In conventional die casting machines, a ladle method has been commonly employed for supplying an aluminum melt to a plunger sleeve. According to the ladle method, an aluminum melt is drawn from a melting furnace by means of a ladle and supplied to a plunger sleeve.

As a technique to take the place of the ladle method, a melt supply pipe method has recently been attracting attention. The melt supply pipe method involves directly connecting a melting furnace and a plunger sleeve with a melt supply pipe, and supplying an aluminum melt through the melt supply pipe to the plunger sleeve. Mixing of an aluminum oxide film or solid broken pieces into an aluminum melt can be significantly reduced by the melt supply pipe method as compared to the conventional ladle method. The melt supply pipe method thus has the advantage that it can provide a higher-quality die-cast product.

A conventional melt supply pipe, which has so far been used to connect a melting furnace and a plunger sleeve, has a structure in which a heater is wrapped around a ceramic pipe. A ceramic material, because of its high melting loss resistance to an aluminum melt, is used for a melt supply pipe.

While a ceramic pipe is strong to an aluminum melt, it is weak to impact and can be broken by its vibration during operation or by erroneous handling upon its maintenance. Further, only an insufficient clamping load can be applied on a connecting portion of such a breakable ceramic pipe, which could cause leakage of an aluminum melt from the connecting portion.

The applicant has proposed an aluminum melt-contact member having enhanced melting loss resistance to an aluminum melt, comprising a steel base, a Ni alloy layer formed on the steel base, and TiC bonded in a particulate state to the surface of the Ni alloy layer (Japanese Patent Laid-Open Publication No. 2005-264306).

DISCLOSURE OF THE INVENTION

In order to address the breakage problem of a ceramic melt pipe, a melt supply pipe has been proposed which comprises an inner ceramic or graphitic pipe which is fit in an outer steel pipe. However, because of a large difference in thermal expansion coefficient between the steel pipe and the ceramic or graphitic pipe, a large gap may be formed between the inner and outer pipes due to their different thermal expansions. An aluminum melt will easily intrude into the gap, which may result in a melting loss of the steel pipe and the formation of holes therein in a short period of time.

It is therefore an object of the present invention to solve the above problems in the prior art and provide a melt supply pipe for aluminum die casting, which is strong to mechanical impact owing to the use of a steel pipe in combination with a ceramic pipe, can prevent intrusion of an aluminum melt despite the difference in thermal expansion between the steel pipe and the ceramic pipe, and is excellent in the melting loss resistance to an aluminum melt, and which can therefore enjoy a significantly extended life.

In order to achieve the object, the present invention provides a melt supply pipe for connecting a melting furnace to a plunger sleeve of a die casting machine in aluminum die casting, said pipe comprising a melt supply pipe body composed of an inner ceramic pipe and an outer steel pipe, said outer steel pipe having a Ni alloy layer formed over the inner circumferential surface, and TiC particles attached to the surface of the Ni alloy layer, wherein grooves are formed at both ends of the melt supply pipe body, each groove forming an annular space overlapping the boundary between the outer circumferential surface of the inner ceramic pipe and the inner circumferential surface of the outer steel pipe, and a fibrous sheet of an inorganic material is inserted into each of the annular grooves.

Preferably, the fibrous sheet has the property of thermally expanding in the thickness direction, and is inserted into the annular groove and extends over the entire circumference of the groove, so that the fibrous sheet will expand in the radial direction of the melt supply pipe.

In a preferred embodiment of the present invention, the fibrous sheet is one produced by mixing an organic binder with heat-resistant inorganic fibers as a main component, and is a long tape-shaped one having a width corresponding to the depth of the annular groove.

According to the present invention, the use of the outer steel pipe can protect the inner ceramic pipe from mechanical impact and, in addition, enables a sufficient clamping load to be applied on a connecting portion at the end of the melt supply pipe, thereby preventing leakage of an aluminum melt. When the outer pipe is heated by an aluminum melt and expands radially, the fibrous sheet also expands in the same direction. This can prevent intrusion of an aluminum melt into the melt supply pipe. Further, TiC particles are densely present on the inner circumferential surface of the outer pipe. Accordingly, should the fibrous sheet become ineffective, the melt supply pipe can still maintain high melting loss resistance. The melt supply pipe of the present invention is thus strong to mechanical impact and, at the same time, has high melting loss resistance to an aluminum alloy, and therefore can enjoy a significantly extended life.

BEST MODE FOR CARRYING OUT THE INVENTION

Preferred embodiments of the melt supply pipe for aluminum die casting according to the present invention will now be described in detail with reference to the drawings.

Figure 1:
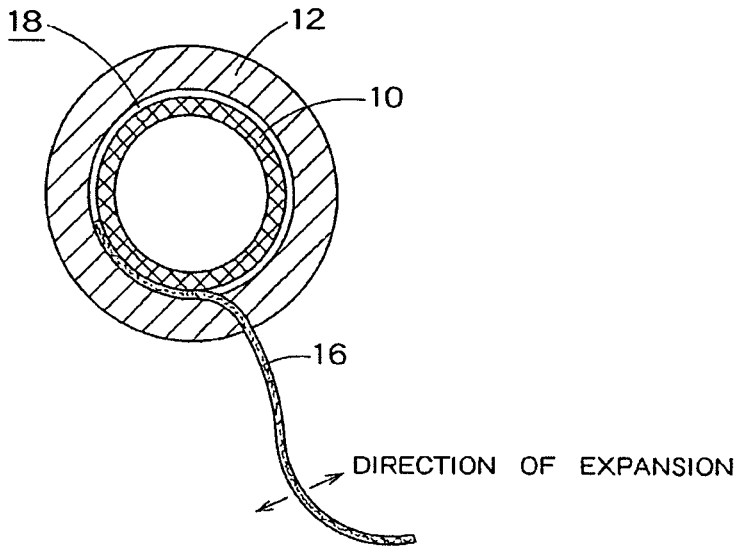
FIG. 1 is a cross-sectional diagram showing a melt supply pipe for aluminum die casting according to an embodiment of the present invention.
Figure 2:
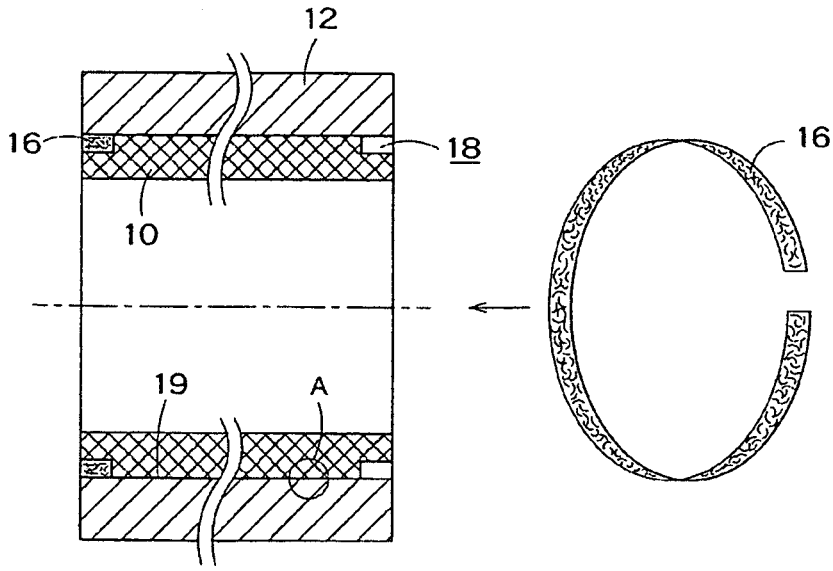
FIG. 2 is a vertical sectional view of the melt supply pipe for aluminum die casting.

FIG. 1 is a cross-sectional diagram showing the structure of a melt supply pipe according to an embodiment of the present invention, and FIG. 2 is a vertical sectional view of the melt supply pipe. In FIGS. 1 and 2, reference numeral 10 denotes an inner ceramic pipe and reference numeral 12 denotes an outer steel pipe. In the melt supply pipe, the inner pipe 10 is fit into the outer pipe 12 to form an integral structure.

A ceramic material, having excellent melting loss resistance to an aluminum melt, is selected for the inner pipe 10, so that the inner pipe 10 can resist melting loss over a long period of time. Such a ceramic material may preferably comprise at least one of Al2O3, SiC, Si3N4, MgO, Al2TiO5, ZrO2 and sialon.

Figure 3:
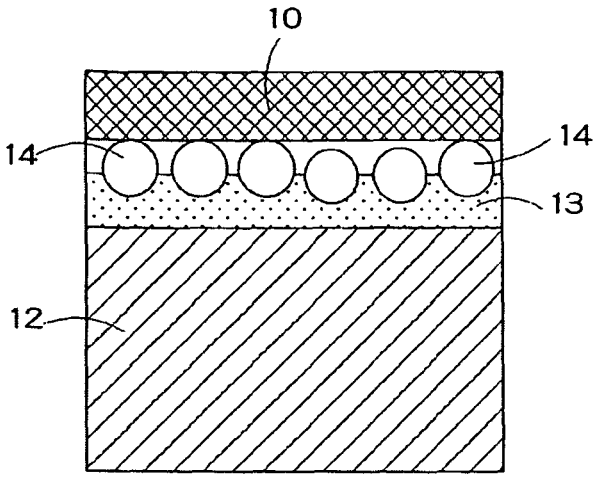
FIG. 3 is an enlarged illustration of the portion A of FIG. 2.

FIG. 3 is an enlarged view of the portion A of FIG. 2. The entire inner circumferential surface of the outer steel pipe 12 is coated with a Ni alloy layer 13, and the entire surface of the Ni alloy layer 13 is covered with a myriad of titanium carbide (TiC) particles 14. The TiC particles 14 are attached to the Ni alloy layer 13 such that they partly protrude from the surface of the Ni alloy layer 13.

The TiC particles 14 can be attached to the inner circumferential surface of the outer steel pipe 12 in the following manner:

First, the Ni alloy layer 13 is formed by thermal spraying or sintering on the inner circumferential surface of the outer pipe 12. Thereafter, a vessel containing TiC powder is prepared, and the outer pipe 12 is entirely buried in the TiC powder.

The vessel, containing the TiC powder and the outer pipe 12 buried in it, is placed in a vacuum heating oven, and heated under vacuum to a temperature at which a liquid phase is generated from the Ni alloy, thereby bonding the TiC particles 14 to the surface of the Ni alloy layer 13. By the heating, through the generation of the liquid phase from the Ni alloy, the TiC particles 14 are bonded to the Ni alloy layer 13 in such a state that they protrude from the surface of the Ni alloy layer 13, as shown in FIG. 3. In this connection, it is undesirable if the TiC particles 14 become entirely covered with the melting Ni alloy in the heating process. In order not to entirely cover the TiC particles 14 with the Ni alloy but to make the TiC particles 14, strongly bonded to the Ni alloy layer 13, partly exposed on the surface of the Ni alloy layer 13, the average particle diameter of the TiC particles 14 is preferably within the range of 10 to 500 μm.

Figure 4:
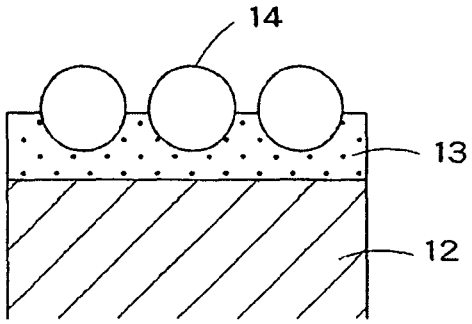
FIG. 4 is a diagram illustrating TiC particles attached to an aluminum alloy layer.

The TiC particles 14 can be bonded to the Ni alloy layer 13 with high strength through the generation of the liquid phase from the Ni alloy. Further, because of good wetting of the Ni alloy with the TiC particles 14, a large number of TiC particles 14 can be densely bonded to the Ni alloy layer 13. Though FIG. 4 schematically shows the TiC particles 14 lining up side by side, there is actually a case in which the TiC particles 14 are piled up in multiple layers.

When the average particle diameter of the TiC particles 14 is smaller than 10 μm, it is difficult to control the temperature during the vacuum heating so that the TiC particles 14 may not be entirely covered with the liquid phase of the Ni alloy. The excellent melting loss resistance of TiC will not be exhibited if the TiC particles 14 are entirely covered with the liquid phase of the Ni alloy.

When the average particle diameter of the TiC particles 14 is larger than 500 μm, on the other hand, the liquid phase of the Ni alloy will cover only low portions of the particles and the contact area between them will not be sufficiently large, resulting in weak bonding strength between the Ni alloy layer 13 and the TiC particles 14. Accordingly, the TiC particles 14 will easily fall off.

Figure 5:
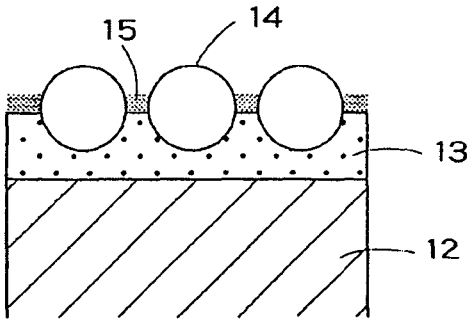
FIG. 5 is a diagram illustrating the case of filling gaps between TiC particles with ceramic powder.

As shown in FIG. 5, gaps between the TiC particles are preferably filled with fine ceramic particles 15 comprising at least one of boron nitride (BN), alumina (Al2O3), zirconia (ZrO2) and silicon nitride (Si3N4).

The fine ceramic particles 15 can be applied in a mixed slurry with a binder to the TiC particles 14, followed by burning. The fine ceramic particles 15 can improve the melting loss resistance of the Ni alloy layer 13 to which the TiC particles 14 are bonded.

Circumferential grooves 18, each for inserting a fibrous sheet 16 thereinto, are formed at both ends of the inner ceramic pipe 10. As shown in FIG. 2, when the inner ceramic pipe 10 is fit into the outer pipe 12, each end surface of the inner pipe 10 is flush with the corresponding end surface of the outer pipe 12 and each groove 18 forms an annular space that opens to the end surfaces.

As shown in FIG. 2, each groove 18 at the end of the inner pipe 10 concentrically overlaps the boundary 19 between the inner pipe 10 and the outer pipe 12, and a fibrous sheet 16 is inserted into the groove 18.

Figures 6A, 6B, 6C:
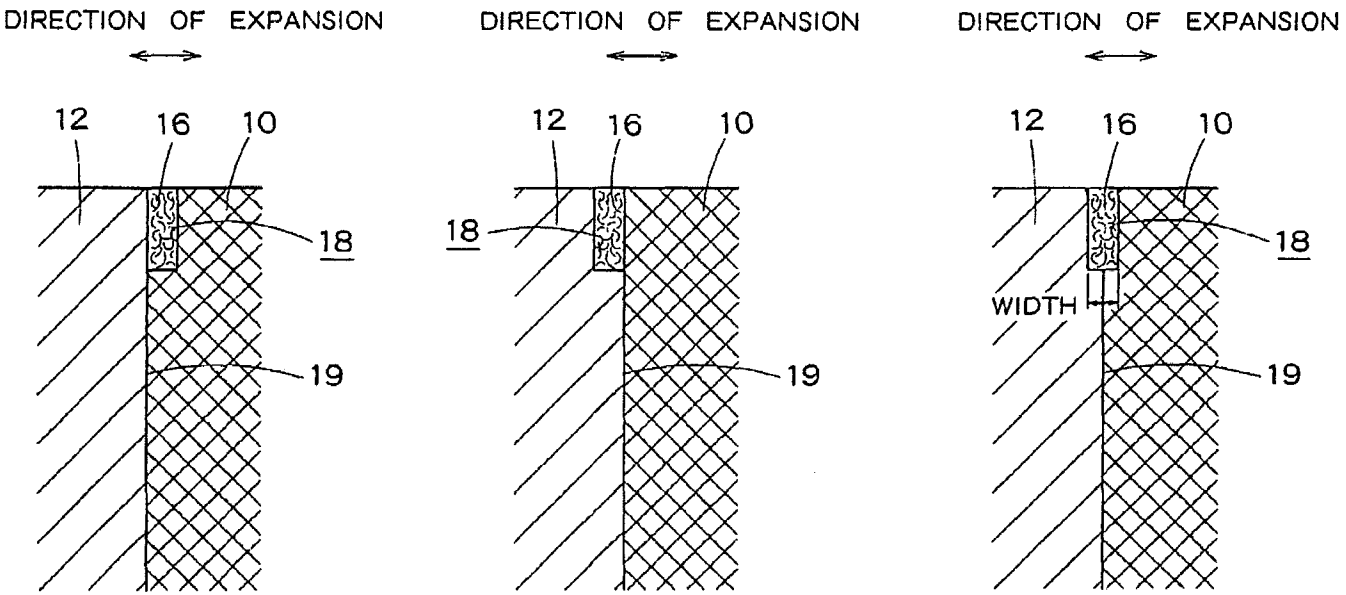
FIGS. 6A through 6C are diagrams showing various positional relationships between a groove and the boundary between an inner pipe and an outer pipe at one end of the melt supply pipe.

The groove 18 may be formed by cutting off an outer circumferential portion of the end surface of the inner pipe 10 (FIG. 6A), by cutting off an inner circumferential portion of the end surface of the outer pipe 12 (FIG. 6B), or by cutting off part of each of the end surfaces of the inner pipe 10 and the outer pipe 12 (FIG. 6C). In the case of FIG. 6A or 6B, the groove 18 overlaps the boundary 19 such that they are in contact at the concentric circle, and in the case of FIG. 6C, the groove 18 concentrically overlaps the boundary 19 in the range of the width of the groove. The groove 18 may concentrically overlap the boundary 19 in any of the relationships shown in FIGS. 6A through 6C.

In this embodiment the fibrous sheet 16 is a sheet member of an inorganic material, having the property of expanding by heating. The fibrous sheet 16 is, for example, one which has been produced by mixing an organic binder with heat-resistant inorganic fibers, such as glass fibers, as a main component.

As shown in FIG. 2, the fibrous sheet 16 is a long tape-shaped one having a width corresponding to the depth of the annular groove 18. The fibrous sheet 16 thermally expands in the thickness direction of the sheet. As shown in FIG. 1, the fibrous sheet 16 is inserted into the groove 18, and the sheet 16 extends over the entire circumference of the groove 18. The direction of thermal expansion of the fibrous sheet 16, when it is thus inserted into the groove 18, coincides with the radial direction of the melt supply pipe.

The melt supply pipe for aluminum die casting, having the above-described construction, has the following advantageous effects:

Firstly, according to the melt supply pipe of this embodiment whose main body is comprised of the combination of the inner ceramic pipe 10 and the outer steel pipe 12, the outer steel pipe 12 can protect the inner ceramic pipe 10 from an external mechanical impact. Furthermore, because the outer pipe 12 is made of a steel material, a sufficient clamping load can be applied to connecting portions at both ends of the melt supply pipe upon connection of the melt supply pipe. This can prevent leakage of an aluminum melt.

Secondly, according to this embodiment, the provision of the fibrous sheets 16 at both ends of the inner ceramic pipe 10 and the outer steel pipe 12 can prevent an aluminum melt from intruding into the boundary 19. It is to be noted in this regard that because of a large difference in thermal expansion coefficient between the inner ceramic pipe 10 and the outer steel pipe 12, the outer steel pipe 12 expands more when the melt supply pipe is heated by an aluminum melt. The thermal expansion consists of the expansion in the length direction and the expansion in the radial direction. When the outer pipe 12 expands in the radial direction, the fibrous sheets 16 also expand in the same direction, whereby the grooves 18 can be blocked up without forming a gap. Thus, owing to the fibrous sheet 16 of an inorganic material having high heat resistance, an aluminum melt can be prevented from intruding from a gap into the boundary 19 between the outer circumferential surface of the inner pipe 10 and the inner circumferential surface of the outer pipe 12.

While prevention of the intrusion of an aluminum melt can be basically attained sufficiently by the fibrous sheet 16 according to the melt supply pipe of this embodiment, the melt supply pipe prepares for a rare but possible case where the fibrous sheet 16 is invaded by an aluminum melt and the aluminum melt intrudes into the boundary 19. In particular, at the boundary 19 between the outer pipe 12 and the inner pipe 10, the TiC particles 14, which exhibit repellency to an aluminum melt, are utilized to prevent direct contact of an aluminum melt with the base material of the outer pipe 12, thereby enhancing the melting loss resistance.

Further, the TiC particles 14 are made to partly extrude from the surface of the Ni alloy layer 13. This can increase the contact angle with an aluminum melt, thereby enhancing the property of repelling the aluminum melt.

In the structure in which TiC is bonded in a particulate state to the Ni alloy layer 13 and densely scattered over the layer, a large thermal stress will not act on the TiC particles 14 even when the outer pipe 12 thermally expands or contracts. Accordingly, the TiC particles 14 hardly fall off and, therefore, the melting loss resistance can be maintained for a long period of time. Since adequate measures are thus taken against melting loss, leakage of an aluminum melt due to a melting loss can be prevented even if the fibrous sheet 16 is damaged and an aluminum melt intrudes into the melt supply pipe.

The base Ni alloy layer 13, to which the TiC particles 14 are bonded, itself has insufficient melting loss resistance to an aluminum melt. The melting loss resistance can be improved by attaching the fine ceramic particles 15 to the Ni alloy layer 13, as shown in FIG. 5. Since the attached fine ceramic particles 15 are present such that they fill in gaps between the TiC particles 14, the fine ceramic particles 15 hardly fall off upon contact with an aluminum melt. It is possible that the fine ceramic particles 15 may adhere also to the surfaces of the protruding portions of the TiC particles 14.

EXPERIMENTAL EXAMPLE

The thus-produced melt supply pipe was fixed in an actual die casting machine to carry out a durability test by repeating a casting cycle of supplying an aluminum melt from a melting furnace through the melt supply pipe to a plunger sleeve of the die casting machine. The test conditions were as follows: the type of aluminum melt, JIS AC4CH; the melt temperature, 720° C.; and the temperature of a melt supply pipe heater, 720° C. Comparative durability tests were also carried out under the same conditions but using, instead of the present melt supply pipe, a ceramic melt supply pipe (composition: 70% SiC-30% Si3N4) (Comp. Example 1) or a melt supply pipe composed of an outer steel (JIS S45C) pipe and an inner graphitic pipe thermally inserted into the outer pipe (Comp. Example 2).

As a result, a connecting portion of the ceramic melt supply pipe broke and the melt began to leak out after about 40,000 shots in Comp. Example 1. In comp. Example 2, a connecting portion of the comparative melt supply pipe broke by melting loss and the melt began to leak out after about 8000 shots. The early melting loss in Comp. Example 2 is considered to be caused by early formation of a gap between the graphitic pipe and the steel pipe due to a large difference in thermal expansion coefficient between them. Thus, intrusion of the melt into the gap may have caused a melting loss of the steel pipe. In contrast, no such defect as melting loss was found in the melt supply pipe of the present invention even after 200,000 shots, and the operation could be continued.

The invention claimed is:

1. A melt supply pipe for connecting a melting furnace to a plunger sleeve of a die casting machine in aluminum die casting, said pipe comprising:

a melt supply pipe body composed of an inner ceramic pipe and an outer steel pipe, said outer steel pipe having a Ni alloy layer formed over the inner circumferential surface, and TiC particles attached to the surface of the Ni alloy layer, wherein grooves are formed at both ends of the melt supply pipe body, each groove forming an annular space overlapping the boundary between the outer circumferential surface of the inner ceramic pipe and the inner circumferential surface of the outer steel pipe, and a fibrous sheet of an inorganic material inserted into each of the annular grooves, wherein the fibrous sheet has the property of thermally expanding in the thickness direction, and is inserted into the annular groove and extends over the entire circumference of the groove, so that the fibrous sheet will expand in the radial direction of the melt supply pipe.

2. The melt supply pipe for aluminum die casting according to claim 1, wherein the fibrous sheet is one produced by mixing an organic binder with heat-resistant inorganic fibers as a main component.

3. The melt supply pipe for aluminum die casting according to claim 2, wherein the fibrous sheet is a long tape-shaped one having a width corresponding to the depth of the annular groove.

4. The melt supply pipe for aluminum die casting according to claim 1, wherein the inner ceramic pipe is composed of a ceramic material comprising at least one of SiC, Si3N4, Al2O3, MgO, Al2TiO5, ZrO2 and sialon.

5. The melt supply pipe for aluminum die casting according to claim 1, wherein said groove is formed in one or both of the outer pipe and the inner pipe such that the groove concentrically overlaps or is concentrically in contact with the boundary between the inner circumferential surface of the outer pipe and the outer circumferential surface of the inner pipe within the range of the width of the groove.

6. The melt supply pipe for aluminum die casting according to claim 1, wherein the TiC particles have an average particle diameter of 10 to 500 μm, and are bonded to the Ni alloy layer in such a state that the particles are not fully covered with the Ni alloy layer but partly protrude from the surface of the Ni alloy layer.

7. The melt supply pipe for aluminum die casting according to claim 1, wherein the Ni alloy has the composition of 2.6 to 3.2% of B, 18 to 28% of Mo, 3.6 to 5.2% of Si and 0.05 to 0.22% of C, with the remainder being Ni and unavoidable impurities.

8. The melt supply pipe for aluminum die casting according to claim 1, wherein gaps between the TiC particles are filled with powder comprising at least one of boron nitride (BN), alumina (Al2O3), zirconia (ZrO2) and silicon nitride (Si3N4).

9. The melt supply pipe for aluminum die casting according to claim 4, wherein gaps between the TiC particles are filled with powder comprising at least one of boron nitride (BN), alumina (Al2O3), zirconia (ZrO2) and silicon nitride (Si3N4).

10. The melt supply pipe for aluminum die casting according to claim 4, wherein the fibrous sheet is one produced by mixing an organic binder with heat-resistant inorganic fibers as a main component.

11. The melt supply pipe for aluminum die casting according to claim 5, wherein the fibrous sheet is one produced by mixing an organic binder with heat-resistant inorganic fibers as a main component.

12. The melt supply pipe for aluminum die casting according to claim 6, wherein the fibrous sheet is one produced by mixing an organic binder with heat-resistant inorganic fibers as a main component.

13. The melt supply pipe for aluminum die casting according to claim 1, wherein the fibrous sheet is a long tape-shaped one having a width corresponding to the depth of the annular groove.

14. The melt supply pipe for aluminum die casting according to claim 2, wherein the inner ceramic pipe is composed of a ceramic material comprising at least one of SiC, Si3N4, Al2O3, MgO, Al2TiO5, ZrO2 and sialon.

15. The melt supply pipe for aluminum die casting according to claim 2, wherein said groove is formed in one or both of the outer pipe and the inner pipe such that the groove concentrically overlaps or is concentrically in contact with the boundary between the inner circumferential surface of the outer pipe and the outer circumferential surface of the inner pipe within the range of the width of the groove.

16. The melt supply pipe for aluminum die casting according to claim 2, wherein the TiC particles have an average particle diameter of 10 to 500 μm, and are bonded to the Ni alloy layer in such a state that the particles are not fully covered with the Ni alloy layer but partly protrude from the surface of the Ni alloy layer.

17. A melt supply pipe for connecting a melting furnace to a plunger sleeve of a die casting machine in aluminum die casting, said pipe comprising:

a melt supply pipe body composed of an inner ceramic pipe and an outer steel pipe, wherein the outer steel pipe has greater thermal expansion in a radial direction than the inner ceramic pipe at the temperature of molten aluminum, said outer steel pipe having a Ni alloy layer formed over the inner circumferential surface, and TiC particles attached to the surface of the Ni alloy layer, wherein grooves are formed at both ends of the melt supply pipe body, each groove forming an annular space overlapping the boundary between the outer circumferential surface of the inner ceramic pipe and the inner circumferential surface of the outer steel pipe, and a fibrous sheet of an inorganic material inserted into each of the annular grooves, wherein the fibrous sheet has the properties of high heat resistance and of thermally expanding in the radial direction at a temperature of molten aluminum, and is inserted into the annular groove and extends over the entire circumference of the groove, so that the fibrous sheet will expand in the radial direction of the melt supply pipe to fill and block up the grooves without forming any gaps to prevent the molten aluminum from intruding into gaps between a boundary between an outer circumferential surface of the inner pipe and an inner circumferential surface of the outer pipe;

wherein exposed surfaces of TiC particles protrude from the Ni alloy into contact with the molten aluminum alloy utilized during aluminum die casting and by which a contact angle between the molten aluminum alloy and the surface is established, such that, as a function of exposed TiC surfaces of the TiC particles protruding from the Ni alloy layer, the contact angle between the surface and the molten aluminum alloy is increased as compared to where the TiC particles are not exposed on the surface, thereby enhancing the surface's property of repelling the molten aluminum alloy.

18. The melt supply pipe for aluminum die casting according to claim 17, wherein the fibrous sheet is one produced by mixing an organic binder with heat-resistant inorganic fibers as a main component.

19. The melt supply pipe for aluminum die casting according to claim 17, wherein said groove is formed in one or both of the outer pipe and the inner pipe such that the groove concentrically overlaps or is concentrically in contact with the boundary between the inner circumferential surface of the outer pipe and the outer circumferential surface of the inner pipe within the range of the width of the groove.

20. The melt supply pipe for aluminum die casting according to claim 17, wherein the TiC particles have an average particle diameter of 10 to 50 μm, and are bonded to the Ni alloy layer in such a state that the particles are not fully covered with the Ni alloy layer but partly protrude from the surface of the Ni alloy layer.

21. The melt supply pipe for aluminum die casting according to claim 20, wherein the fibrous sheet is one produced by mixing an organic binder with heat-resistant inorganic fibers as a main component.

22. The melt supply pipe for aluminum die casting according to claim 21, wherein said groove is formed in one or both of the outer pipe and the inner pipe such that the groove concentrically overlaps or is concentrically in contact with the boundary between the inner circumferential surface of the outer pipe and the outer circumferential surface of the inner pipe within the range of the width of the groove.

23. The melt supply pipe for aluminum die casting according to claim 22, wherein the Ni alloy has the composition of 2.6 to 3.2% of B, 18 to 28% of Mo, 3.6 to 5.2% of Si and 0.05 to 0.22% of C, with the remainder being Ni and unavoidable impurities.

24. The melt supply pipe for aluminum die casting, according to claim 23, wherein gaps between the TiC particles are filled with powder comprising at least one of boron nitride (BN), alumina (Al2O3), zirconia (ZrO2) and silicon nitride (Si3N4).

* * * * *